US006006744A

United States Patent [19]

Taylor

[11] Patent Number: 6,006,744

[45] Date of Patent: Dec. 28, 1999

[54] FIREPLACE TRAY

[76] Inventor: Bernice Taylor, 8920 Woodstock Wy., Fishers, Ind. 46038

[21] Appl. No.: 09/302,947

[22] Filed: Apr. 30, 1999

[51] Int. Cl.[6] ..... F24B 1/193

[52] U.S. Cl. ..... 126/543; 126/243; 126/555

[58] Field of Search ..... 126/242–245, 126/543, 544, 164, 154 R

[56] References Cited

U.S. PATENT DOCUMENTS

| | | | |
|---|---|---|---|
| 312,331 | 2/1885 | Cissel | 126/244 |
| 420,559 | 2/1890 | Lincoln | 126/243 |
| 1,155,875 | 10/1915 | Blass | 126/244 |
| 1,308,245 | 7/1919 | Klucina | 126/244 |
| 4,074,679 | 2/1978 | Jensen | 126/121 |
| 5,010,874 | 4/1991 | Toth | 126/543 |
| 5,513,625 | 5/1996 | Landman | 126/152 |

FOREIGN PATENT DOCUMENTS

| | | | |
|---|---|---|---|
| 33762 | 11/1885 | Germany | 126/243 |
| 727268 | 3/1955 | United Kingdom | 126/242 |
| 992340 | 5/1965 | United Kingdom | 126/243 |

*Primary Examiner*—James C. Yeung
*Attorney, Agent, or Firm*—Gerald H. Glanzman

[57] ABSTRACT

A fireplace tray positionable on the floor of a fireplace to receive and collect ashes from burning logs in the fireplace. The tray has a collector portion which receives and collects the ashes, a rotatable support mounted to the collector toward a back wall thereof to roll the tray into and out of the fireplace and a front support mounted to the collector toward a front wall thereof to retain the tray in position in the fireplace. The fireplace tray preferably also includes handles mounted to the collector to facilitate handling of the tray and other features which permit collected ashes to be easily disposed of while maintaining the fireplace substantially clean at all times.

17 Claims, 5 Drawing Sheets

FIREPLACE TRAY

BACKGROUND OF THE INVENTION

1. Field of the Invention

The present invention relates generally to a fireplace tray; and, more particularly, to a tray which is insertable into a fireplace to receive and collect ashes from burning logs in the fireplace and which is easily removable from the fireplace to permit convenient disposal of the ashes.

2. Description of the Prior Art

Most people consider a fireplace to be a desirable feature in a home. As a result, most houses include at least one fireplace, and many apartments that have been built in recent years include a functioning fireplace as well.

Usually, a fireplace grate is used to support logs to be burned in the fireplace. A fireplace grate typically comprises a plurality of metal bars shaped and welded together to form a rack to hold the logs above the floor of the fireplace. This provides for better burning of the logs and prevents the logs from rolling out of the fireplace.

As the logs burn on the grate, the ashes simply fall onto the floor of the fireplace and accumulate thereon such that the floor must periodically be cleaned. Removal of the ashes from the floor of the fireplace is a messy and time-consuming job; and, as a result, many people tend to clean their fireplace rather infrequently, allowing the ashes to build up to an unsightly level. Some people find the process of cleaning their fireplace to be so distasteful that they are hesitant to even use their fireplace to any significant extent, while others use manufactured logs which burn somewhat cleaner than wood logs or install a gas fireplace unit in their fireplace which leaves no ashes. Manufactured logs or gas fireplace units generally do not provide as attractive a fire as wood logs, and most people would prefer to burn wood if the fireplace did not become so messy and difficult to clean.

In an effort to alleviate the problem of cleaning a fireplace, various fireplace cleaning tools have been developed and are available in the marketplace. These tools typically include a small broom to sweep up the ashes that have accumulated on the fireplace floor and a small shovel to pick up the ashes and to transfer the ashes to a box, trashbag or the like for disposal. Such tools, however, do not clean the fireplace very well and also tend to disturb the ashes causing clouds of ashes to rise up into the air and to settle onto furniture and other surfaces in the room.

Also known are grates which have a built-in tray or drawer to catch the ashes as they fall from the burning logs (see for example, U.S. Pat. No. 5,513,625). Such grates, however, are not very attractive and prevent one from using an existing grate that he may have or from selecting a grate design that he might prefer.

SUMMARY OF THE INVENTION

The present invention provides a fireplace tray that is positionable on the floor of a fireplace to receive and collect ashes falling from burning logs, and that is easily removable from the fireplace to be carried to a convenient location where the collected ashes may be simply dumped out of the tray.

A fireplace tray according to the present invention has a collector for receiving and collecting ashes from logs burning in a fireplace, the collector having a base and front, back and side walls extending upwardly from the base. In addition, the tray includes a rotatable support mounted to the collector toward the back wall thereof to roll the tray into and out of the fireplace, and a front support mounted to the collector toward the front wall thereof to retain the tray in position in the fireplace.

The fireplace tray of the present invention can be easily rolled into a fireplace for use in collecting ashes, and rolled out of the fireplace, picked up and carried to a suitable location to be dumped out to dispose of the ashes. With the fireplace tray of the present invention, the floor of the fireplace will remain substantially clean, and the necessity of cleaning the fireplace will be greatly reduced.

Preferably, the fireplace tray of the present invention includes a handle extending from the front wall of the collector to faciliate insertion into and removal of the tray from the fireplace. This handle can be in any desired configuration, and, if desired, can be a decorative member such as a brass handle or the like.

According to a presently preferred embodiment, the rotatable support comprises an elongated roller mounted to the collector and extending across the base from one side of the collector to the other. It has been found that a roller can be manufactured at low cost and can effectively withstand the high temperatures encountered in the fireplace. Wheels could also be used, if desired, but are presently not preferred as they appear to be more susceptible to warping.

The fireplace tray of the present invention can be custom made to fit fireplaces of any configuration. For example, many fireplaces are built with tapered side walls to define a trapezoidal-shaped fireplace floor, and the tray of the present invention can easily be configured to properly fit into such a fireplace. Alternatively, the tray of the invention could be manufactured in several "standard" rectangular shapes for use in any fireplace. In this embodiment, the tray can be inserted into a fireplace between the legs of a grate or be of a size such that the grate will be positioned on top of the tray. Either way, the tray will effectively receive and collect the ashes from burning logs supported by the grate for easy removal.

In accordance with a further embodiment of the invention, the fireplace tray may also include a cover which can be slid onto or otherwise positioned on the collector to close the collector prior to removal of the tray from the fireplace for disposal of the ashes therein. This cover will help ensure that ashes will not spill out of the collector as the tray is being carried to a location for disposal of the ashes.

In addition, the fireplace tray of the invention can include a removable rack that is positionable over the collector when the tray is in use. Such rack is formed of a plurality of bars which are spaced to permit ashes to fall therethrough into the collector, but which will catch larger pieces that occasionally fall from burning logs so that they may be reburned at a later time if desired.

In general, the fireplace tray of the present invention provides an apparatus which will help keep a fireplace clean and which permits ashes to be easily collected and disposed of The fireplace tray of the invention can be used with existing fireplace grates and is of a sufficiently low profile that it will not detract from the overall appearance of the fireplace.

Yet further advantages and specific features of the invention will become apparent hereinafter in conjunction with the following detailed description of presently preferred embodiments of the invention.

DETAILED DESCRIPTION OF THE PRESENTLY PREFERRED EMBODIMENTS

Figure 1:
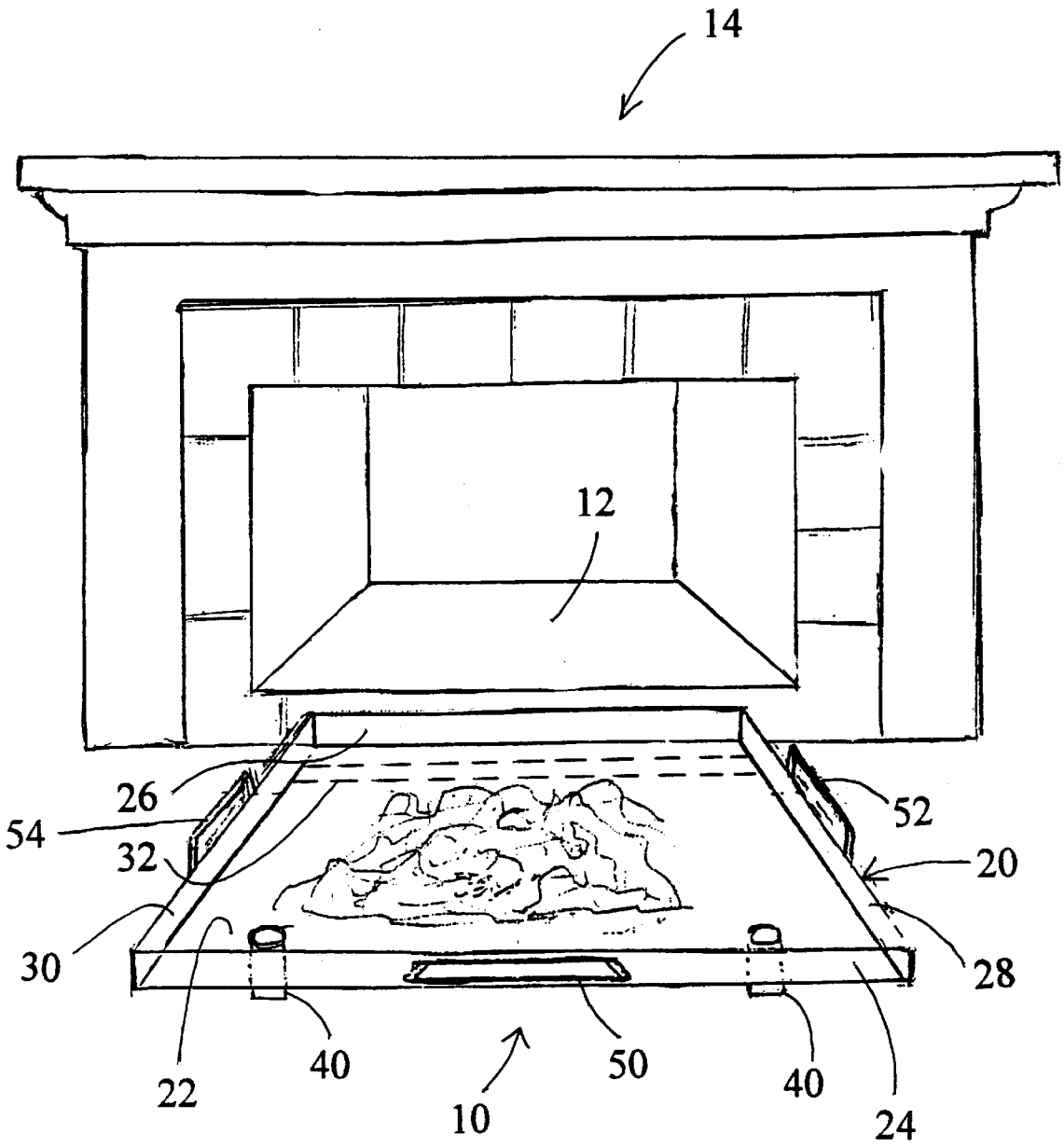
FIG. 1 is a plan view schematically illustrating a fireplace tray according to one presently preferred embodiment of the invention and a fireplace within which the tray may be used.

FIG. 1 illustrates a fireplace tray according to a first presently preferred embodiment of the invention in conjunction with a fireplace with which the tray may be used. The fireplace tray is generally designated by reference number 10 and is adapted to be positioned on the floor 12 of the fireplace 14 to receive and collect ashes generated by the burning of logs in the fireplace as will be explained hereinafter.

The fireplace tray 10 includes a collector portion 20 which comprises a base 22, a front wall 24, a back wall 26 and opposed side walls 28 and 30 as shown in FIG. 1. The base and walls of the collector portion are preferably formed from a single sheet of steel or the like that is able to reliably withstand the heat generated in the fireplace without warping, and that is relatively light in weight so that it can be easily carried. A galvanized steel sheet having a thickness of about 12 gauge has been found to be suitable. The walls are about two inches high and are provided to help retain ashes that accumulate on the base 22 of the collector. This is exemplary only as the walls could be of different heights; however, a height of about two inches is generally preferred as it will provide the tray with a sufficiently low profile as to not detract from the overall appearance of the fireplace.

In the embodiment of FIG. 1, the lateral dimensions of the collector 20 are selected to be slightly smaller than the dimensions of the floor 12 of the fireplace 14 so that it will substantially cover the floor when the tray is inserted into the fireplace. In the embodiment of FIG. 1, the floor 12 of the fireplace 14 is of a trapezoidal shape; narrower at the back than at the front; and, accordingly, the collector is similarly shaped. Specifically, the dimensions of the illustrated collector is 27 inches wide in front, 19 inches wide in back and 13 inches deep. Of course, for differently sized and shaped fireplaces, the collector would be sized and configured correspondingly.

Figure 2:
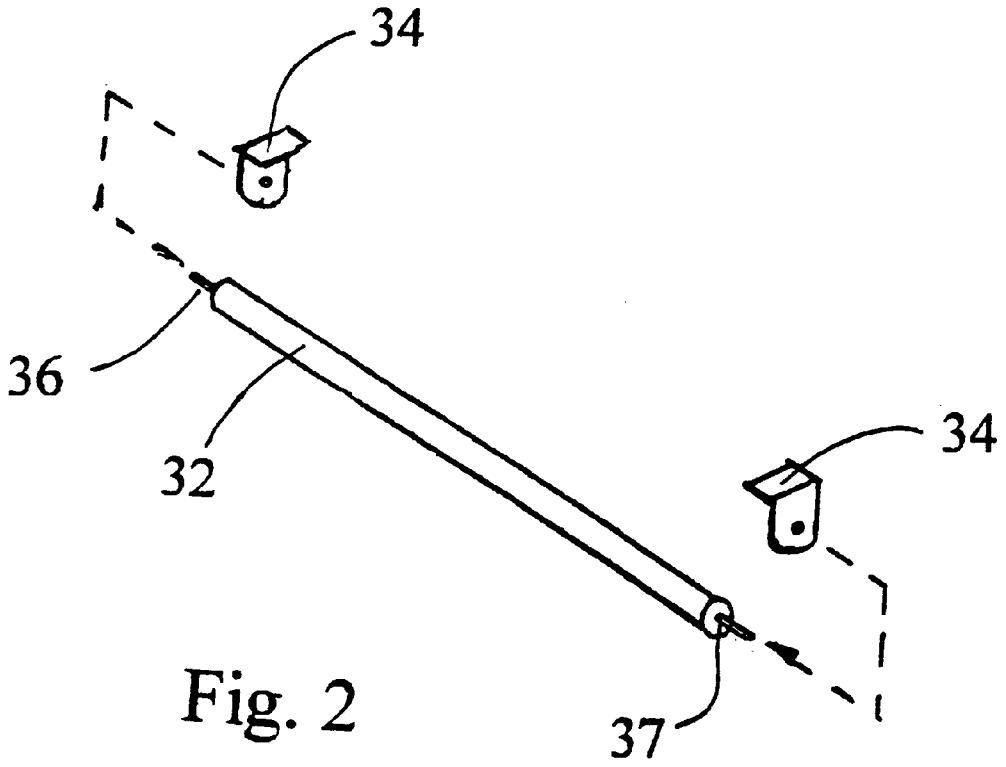
FIG. 2 is an exploded view illustrating the roller structure of FIG. 1.
Figure 3:
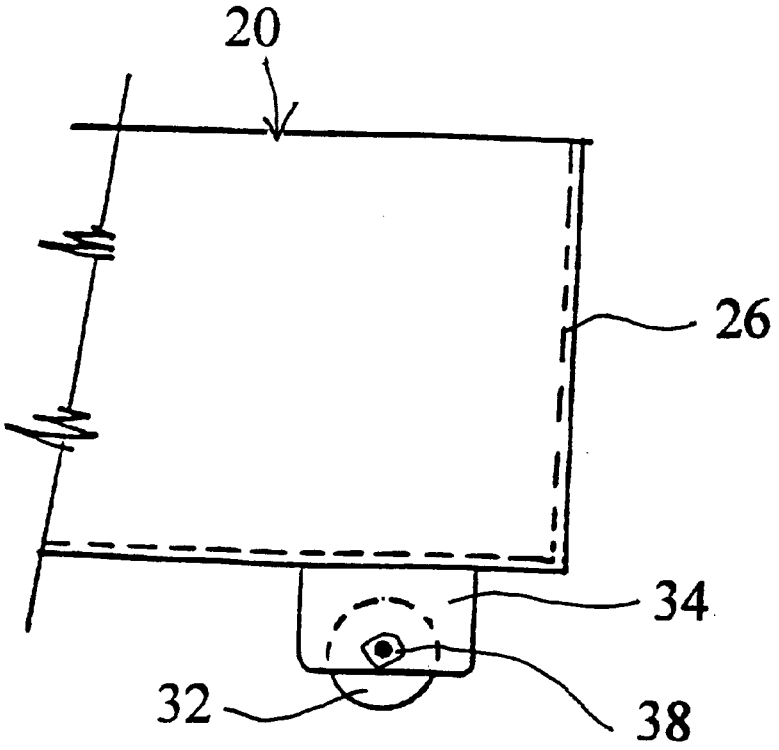
FIG. 3 is a partial left side view of the fireplace tray of FIG. 1 illustrating the mounting of the roller structure to the collector.

As shown in dotted line in FIG. 1 and in greater detail in FIGS. 2 and 3, a rotatable member in the form of an elongated roller 32 is mounted to the collector toward the back wall thereof to permit the tray to be easily rolled into and out of the fireplace. The roller is supported between a pair of brackets 34 attached to the side walls of the collector and which extend downwardly therefrom somewhat below the base of the collector. Specifically, the roller 32 includes an axial bore 37 extending therethrough, and is supported beneath the base by a rod 36 which extends through the bore and is attached at its ends to the brackets 34 by, for example, threaded nuts 38. The roller is preferably formed of steel or another material that can effectively withstand the high temperatures in the fireplace, and preferably has a diameter of about one-half inch. The brackets 34 support the roller so as to maintain the base of the collector about ⅝th inch above the floor of the fireplace.

It is also possible to use a pair of wheels to support the collector instead of the roller; however, the roller is preferred as wheels will tend to warp under the high temperatures encountered in the fireplace. As best shown in FIG. 3, the roller is mounted to the collector about one-half inch from the back side of the collector 20.

Attached at the front side of the collector are a pair of support legs which support the front end of the collector above the floor of the fireplace. In FIG. 1, the legs comprise a pair of pegs 40 which are formed of steel and are sized to extend downwardly from the base 22 of the collector by about ⅝th inch so that the collector will sit flat on the floor of the fireplace. The pegs can conveniently be attached to the inside surface of the front wall 24 of the collector as by welding, and extend through openings formed in the base. The pegs help to prevent the tray from moving around and generally help keep the tray in position in the fireplace.

Figure 5:
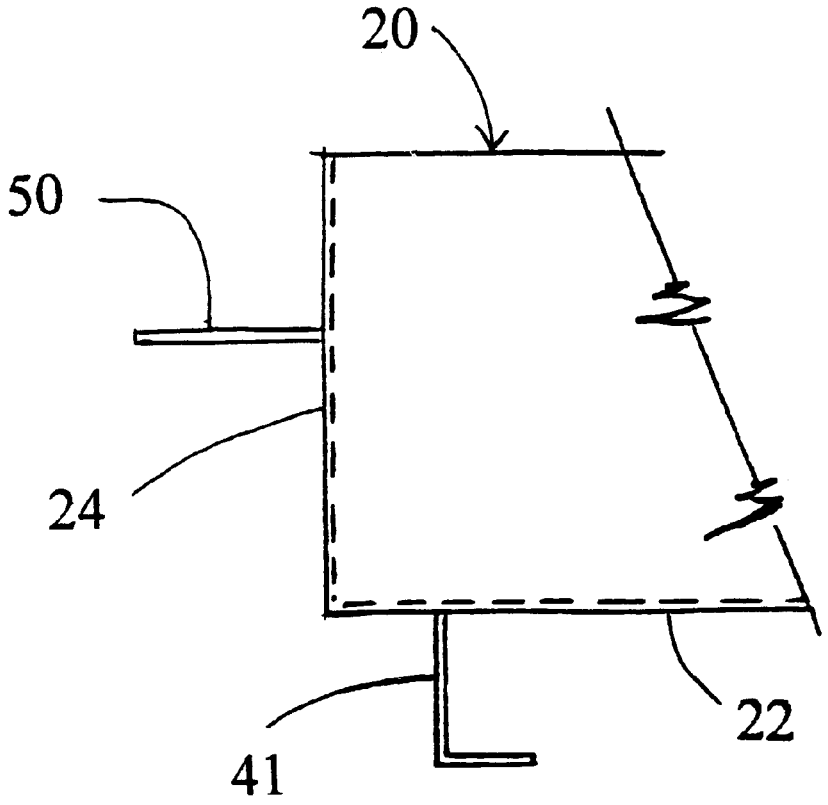
FIG. 5 is a partial left side view of the fireplace tray of FIG. 1 illustrating a support leg according to a further embodiment of the invention.

According to an alternative embodiment, the support legs can also be in the form of bent steel members as shown, for example, at 41 in FIG. 5. Members 41 can be welded, bolted or otherwise attached to the bottom surface of base 22 as is known to those skilled in the art.

The tray is also provided with handles in the front and at the sides thereof to facilitate handling of the tray. A first handle 50 is attached to and extends from the front wall 24 of the collector for use in pushing the tray into and pulling the tray out of the fireplace. This handle can be of any desired configuration; and, if desired, can be selected to be of a decorative nature. For example, the handle could be made of brass or other decorative material and can be provided in any desired shape or style.

Figure 4:
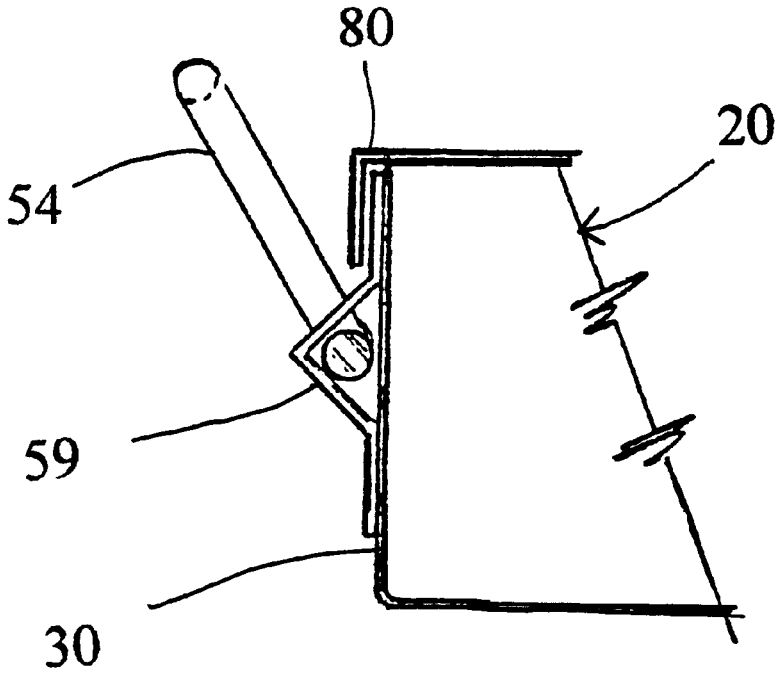
FIG. 4 is a partial front view of the fireplace tray of FIG. 1 illustrating a side handle according to a further embodiment of the invention.

Side handles 52 and 54 are attached to the side walls 28 and 30, respectively, of the collector substantially centrally thereof. These handles can be of any appropriate configuration and are used to lift up the tray after it has been withdrawn from the fireplace so that the tray can easily be carried to a suitable location for disposal of the ashes accumulated therein. In FIG. 1, the side handles 52 and 54 are rigidly attached to the sidewalls of the collector and extend upwardly therefrom. In an alternative embodiment as shown in FIG. 4, the handles 52 and 54 are pivotally supported in brackets 59 so that they normally extend downwardly substantially out of view, but can be turned upwardly when they are used to carry the tray.

To use the fireplace tray 10, any grate present in the fireplace should first be removed. The tray is then inserted into the fireplace. This can easily be accomplished by grasping the front handle 50, lifting the front end of the tray slightly and then rolling the tray into the fireplace until it is in position. If the floor of the fireplace is raised with respect to the floor of the room, the tray can be lifted as necessary by the side handles 52 and 54 to position the support roller 32 on the floor of the fireplace before rolling the tray into the fireplace.

After the tray 10 has been properly positioned, the grate can be placed in the fireplace on top of the base of the tray, logs positioned on the grate, and a fire started. As the logs burn, ashes from the logs will fall onto the base of the tray and be accumulated thereon. They will generally not fall onto and dirty the floor of the fireplace.

When it is desired to remove the ashes from the fireplace, it is only necessary to remove the grate, grasp the tray by the front handle 50 and pull the tray out of the fireplace. The tray can then be picked up by the side handles and carried to a suitable location to dump out the ashes. Normally, it will not be necessary to further clean the tray. The tray can then be returned to the fireplace and the grate repositioned, and the fireplace will be ready to start a new fire whenever desired.

With the fireplace tray of the present invention, removal of ashes from the fireplace is such a simple procedure that the ashes can be removed after each fire, if desired, without allowing the ashes to accumulate. Also, if desired, the tray can be simply removed from the fireplace when there is no fire and inserted only when a fire is desired. In general, the fireplace itself will remain substantially clean at all times.

Figure 6:
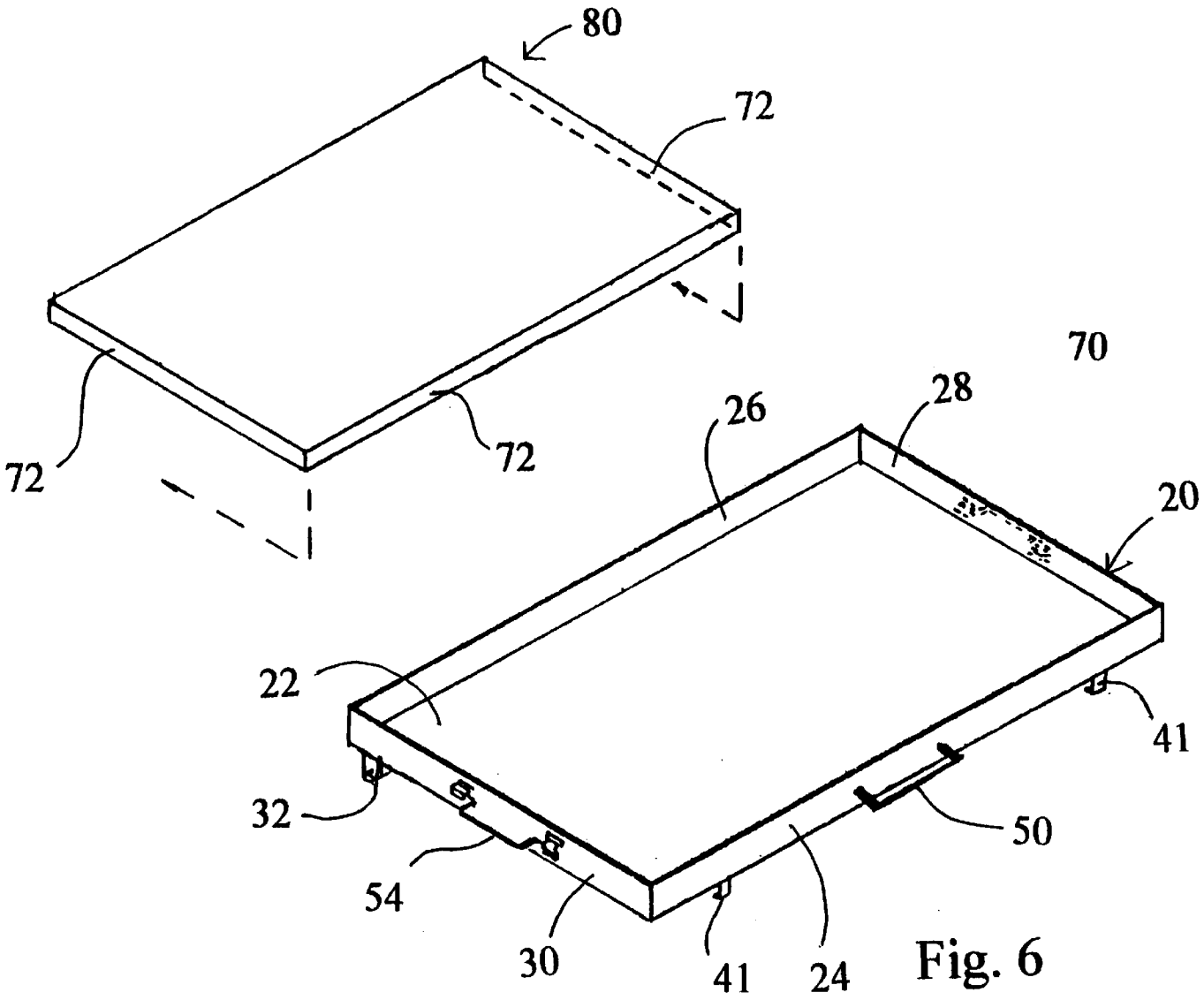
FIG. 6 illustrates a fireplace tray according to an alternative embodiment of the invention.

FIG. 6 illustrates an alternative embodiment of the invention. Specifically, while the fireplace tray of FIG. 1 is custom-made to the fireplace with which it is to be used, FIG. 6 illustrates a fireplace tray 70 manufactured in a "standard" size for use in a variety of fireplaces. Specifically, fireplace tray 70 is similar in construction to fireplace tray 10 but is smaller and is manufactured in a generally rectangular shape. Tray 70 is typically sized so that it will fit in the fireplace under a grate. It may be sized to fit between the legs of existing grates so that it may be inserted into and removed fom the fireplace without removing the grate, or it may be made slightly larger so that the legs of the grate will rest on the tray as in the embodiment of FIG. 1. In either version, the tray can be manufactured in a few appropriate sizes for use in essentially any fireplace and with essentially any existing grate. In the embodiment shown in FIG. 6, for example, the tray is about 17 inches wide and about 8 inches deep.

FIG. 6 also illustrates a further feature that may be included in the fireplace tray of the present invention. In particular, if desired, the tray may be provided with a cover 80 for the collector 20 which may be installed when the tray is to be removed from the fireplace for disposal of the ashes. The cover 80 can be used to close the collector while the tray is being carried to prevent any spilling of the ashes. In FIG. 6, the cover 80 is formed with downwardly extending walls 72 in front and on the sides, but without a wall in back so that it may simply be slid onto the collector from the front end of the collector. Of course, this is exemplary only as the cover may be positioned over the collector in any desired manner. FIG. 4 also illustrates the cover 80 in position on top of the collector 20.

Figure 7:
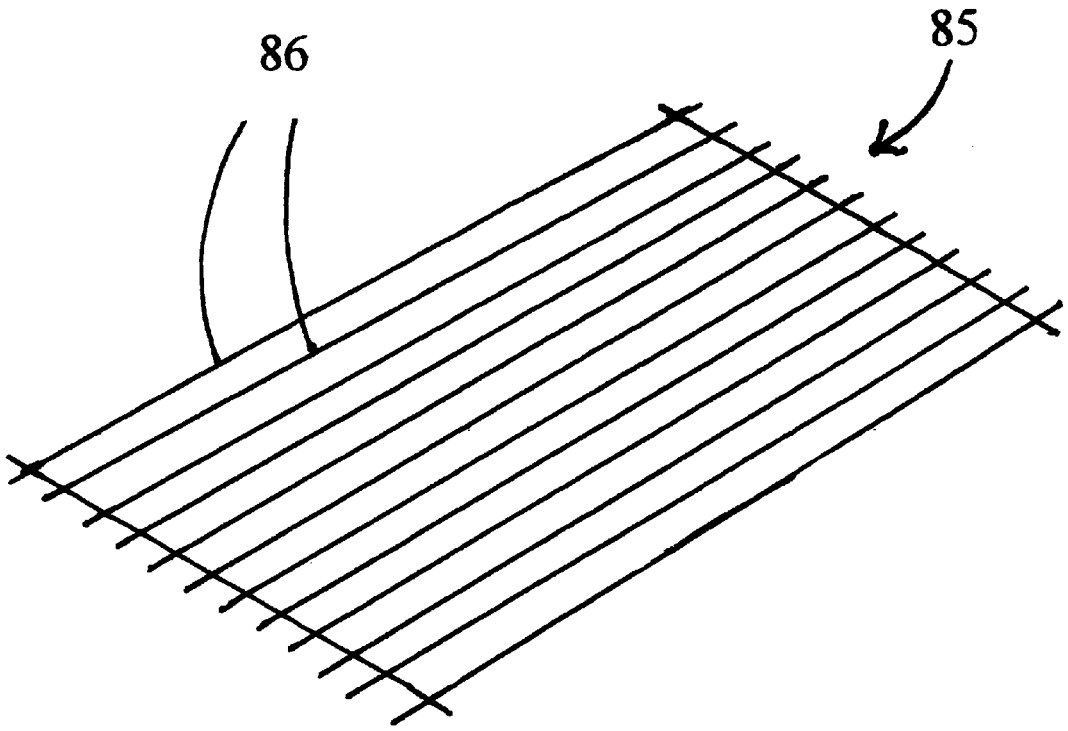
FIG. 7 illustrates a rack which may be included in the fireplace tray according to yet a further embodiment of the invention.

FIG. 7 illustrates yet a further feature of the invention. Specifically, if desired, the fireplace tray can include a rack 85 positionable over the collector such as by simply laying the rack on top of the collector. The rack 85 is formed with a plurality of bars or rods 86 which are spaced so as to permit ashes to fall therebetween into the collector, but to catch larger pieces that occasionally fall from a burning log so that such larger pieces may be reused at a later time, if desired. The rack is sized so that it will sit on top of the collector portion of the tray, and can be included in either the custom-made or standard sized version of the fireplace tray.

While what has been described consitutes presently preferred embodiments of the invention, it should be recognized that the invention could take numerous other forms. Accordingly, it should be understood that the invention should be limited only insofar as is required by the scope of the following claims.

I claim:

1. A fireplace tray positionable on a floor of a fireplace to receive and collect ashes from burning logs in the fireplace, comprising:

a collector for receiving and collecting ashes from said burning logs, said collector including a base and front, back and side walls extending upwardly from said base, a rotatable support mounted to the collector toward the back wall thereof to roll the tray into and out of the fireplace, a front support mounted to the collector toward the front wall thereof to retain the tray in position in the fireplace, and a handle at the front wall to assist in pushing said tray into and pulling said tray out of said fireplace.

2. The fireplace tray of claim 1 and further including a handle mounted to each side wall to lift and carry said tray.

3. The fireplace tray of claim 2 wherein the handle mounted to each side wall is pivotally mounted to a side wall.

4. The fireplace tray of claim 1 wherein said rotatable support comprises an elongated roller extending across said base.

5. The fireplace tray of claim 4 wherein a bracket extends from each side wall and wherein said roller is supported between said brackets to extend beneath said base.

6. The fireplace tray of claim 4 wherein said elongated roller has a diameter of about one-half inch.

7. The fireplace tray of claim 1 wherein said front support comprises a pair of support legs.

8. The fireplace tray of claim 1 and further including a cover removably mounted to said collector for covering said collector during carrying of said tray for disposing of ashes therein.

9. The fireplace tray of claim 1 and further including a rack positionable on top of said collector when said tray is in said fireplace for catching larger pieces falling from said burning logs while permitting said ashes to fall therethough into said collector.

10. The fireplace tray of claim 1 wherein said tray is sized and configured to have substantially the same size and configuration as the floor of said fireplace.

11. The fireplace tray of claim 1 wherein said fireplace tray is of substantially rectangular shape.

12. The fireplace tray of claim 11 wherein said tray is sized to fit underneath a grate supporting said burning logs in said fireplace and between legs of said grate.

13. A fireplace tray positionable on a floor of a fireplace to receive and collect ashes falling from burning logs in the fireplace, comprising:

a collector for receiving and collecting ashes from said burning logs, said collector including a base and front, back and side walls extending upwardly from said base;

a front handle extending from said front wall to push said tray into and pull said tray out of said fireplace;

side handles extending from said side walls for lifting and carrying said tray;

a rotatable support toward the back wall of said collector for rolling said tray into and out of said fireplace, said rotatable support comprising an elongated roller extending across said base of said collector; and a front support toward said front wall of said collector for retaining the tray in position in said fireplace.

14. The fireplace tray of claim 13 and further including a cover removably mountable on said collector.

15.The fireplace tray of claim 14 and further including a grid having a plurality of spaced bars positionable on top of said collector for allowing ashes to fall therethrough into said collector while catching larger pieces falling from said burning logs.

16. The fireplace tray of claim 14 wherein said tray is sized and configured to be substantially the same size and configuration as the floor of said fireplace.

17. The fireplace tray of claim 14 wherein said tray is substantially rectangular shaped and is sized to fit between legs of a grate supporting said burning logs.

* * * * *